United States Patent [19]

Herrington

[11] Patent Number: 4,472,923

[45] Date of Patent: Sep. 25, 1984

[54] CARTON LOADER

[75] Inventor: F. John Herrington, Holcomb, N.Y.

[73] Assignee: Mobil Oil Corporation, New York, N.Y.

[21] Appl. No.: 290,642

[22] Filed: Aug. 6, 1981

[51] Int. Cl.[3] ..... B65B 57/00

[52] U.S. Cl. ..... 53/429; 53/120; 53/539; 53/540

[58] Field of Search ..... 53/120, 429, 538–540

[56] References Cited

U.S. PATENT DOCUMENTS

| | | | |
|---|---|---|---|
| 3,309,834 | 3/1967 | Buttery | 53/429 |
| 3,656,271 | 4/1972 | O'Shea | 53/120 X |
| 3,977,152 | 8/1976 | Rochla | 53/120 X |
| 4,086,745 | 5/1978 | Caudle | 53/540 |
| 4,333,298 | 6/1982 | Lehmacher | 53/258 X |

*Primary Examiner*—A. J. Heinz

*Attorney, Agent, or Firm*—Charles J. Speciale; James P. O'Sullivan; Alexander J. McKillop

[57] ABSTRACT

A novel method and apparatus is disclosed for the loading of a carton with a full complement of plastic bags and a cardboard insert. A plunger descends and contacts an insert which, in turn, forces a stack of plastic bags into an empty carton disposed directly below. A pair of intermeshing rollers are also provided to further guide the bags into the carton. Both gusseted and non-gusseted bags can easily be loaded pursuant to the teachings of the present invention.

27 Claims, 7 Drawing Figures

CARTON LOADER

BACKGROUND OF THE INVENTION

1. Field of the Invention

The present invention relates generally to a novel process and apparatus for the packaging or loading of articles in containers and, more particularly, pertains to a process and apparatus for the simple and efficient automatic loading of a carton with a full complement of plastic bags.

The inventive arrangement effectively provides a novel process and apparatus for the loading of a container with plastic sandwich bags, and further provides a cardboard insert to be simultaneously inserted and later retained within the container to prevent the bags from collapsing into a heap within the container or carton when the carton becomes partly empty after a number of bags have been dispensed.

2. Discussion of the Prior Art

The present state of the art related to the loading of plastic bags within cartons is extensive and such art has developed numerous techniques for the packaging of cartons. A well known method for loading a stack of plastic bags into a container is to place a stack of bags beneath an arm, or plunger, and dispose a carton therebeneath. The arm then normally forces the stack of bags into the carton by applying a downwardly directed force to the stack directed to the center of the bags. Typically, this method is described as "plunge-loading" and is well known in the art.

This loading method normally utilizes a rapid application of a downwardly applied force with the plunger having a substantially linear contact with the uppermost bag of the stack along a contact line approximately coincident with the vertical plane which bisects the dimensions of the opening of the carton disposed below through which the bags are to be forced. This type of forcing causes the bag stack to buckle upward into a stack having a U-shaped configuration which is forced into the carton disposed below.

As is also well known in the prior art, numerous problems are encountered in attempting to repetitively load cartons with plastic bags, and additional problems have been particularly caused by attempting to package bags which are non-symmetrical, i.e. sandwich bags which have one end gusseted. Specifically, by merely forcing a stack of bags into a carton, friction between the bags and their support platform or retainer, combined with the action of the plunger arm, normally causes the bags to enter the carton off center, i.e. the plunger pulling more bags from one side than the other. This causes the bags to be non-centered upon entry into the carton resulting in bags which extend over the sides of the opening. In extreme situations, this non-centering action can further cause the stack of bags to miss the carton entirely. This off-centering problem becomes greatly compounded when non-symmetrical bags are packaged. Sandwich bags typically containing a gusset at one end thereof, have two times the thickness of the plastic at the gusseted end as compared to the non-gusseted end. This causes the total stack of bags to be much thicker at one end thereby tending to skew the entire stack. This skewing consequently creates a centering problem for the rapid packaging of bags within the carton, or container, disposed below.

Another problem associated with all types of plastic article loaders is the slumping of the bags within the container after a number of bags have been dispensed. If the carton is overly deep, the consumer must strain to grasp the remaining bags within the carton. Consequently, an insert can be placed within the carton to provide sufficient support to the undispensed bags to prevent any slumping. This insertion of a cardboard insert normally requires a separate assembly step which consequently increases the overall production cost of the product.

None of the prior art, of which O'Shea, et al. U.S. Pat. No. 3,805,482; Clancy U.S. Pat. No. 3,481,099; Rochla, et al. U.S. Pat. No. 3,977,152; and Olson U.S. Pat. No. 4,044,919 are typical, show or even suggest the apparatus and process as described herein as a solution to the aforementioned problems.

As illustrated in O'Shea, et al. U.S. Pat. No. 3,805,482, the invention therein discloses a means for automatically stuffing a folded stack of flexible articles into an empty carton disposed therebeneath. O'Shea, et al. provides a stuffer head which is drawn downwardly to engage a stack of folded bags and stuffs the bags through chute guide plates into an empty carton resting immediately therebelow. A connecting rod then withdraws the stuffer from the carton to complete the stuffing operation. O'Shea, et al., however, does not teach any solution to the aforementioned problems and particularly does not even mention the frictional problems associated with the chute guide plates, nor is any provision made regarding non-symmetrical, i.e. gusseted, bags. Further, no insert, resilient or otherwise, is deposited in the container to support the articles therein. This reference merely shows the state of the general technology related to loading cartons.

Clancy U.S. Pat. No. 3,481,099 discloses a packaging apparatus and method for the loading of a folded towelette into a V-shaped envelope. An insertion block is slidably mounted to enable it to descend to fold and thrust the towelette into the envelope. Clancy further discloses rollers to help guide the towelette into the envelope. Although this patent is directed to making sealed packages containing folded liquid absorbent sheets, it is considered to be of only general relevance. Clancy does not teach any solutions to the aforementioned problems and specifically, no insert is provided for support, and the rollers do not have synchronized movement. Without such synchronization, the rollers will not prevent non-centered loading because the plunger may pull the bags more from one side than the other. Further, no solution is taught concerning the problems associated with non-symmetrical, i.e. gusseted articles.

Rochla, et al. U.S. Pat. No. 3,977,152 discloses a method and apparatus for the packaging of flexible flat good by inserting a stack of bags into an opened half tube of film and, while partially pressing the included air, welding such bags therein by utilizing a separating weld seam which closes the open film edges and another separating weld seam extending perpendicular thereto to form bag packages. Although this patent is not directed to the particular problems solved by the present invention, it does disclose non-synchronized rollers to help guide the stack into the open envelope.

Finally, Olson U.S. Pat. No. 4,044,919 discloses the use of a resilient insert within a carton to support the articles therein. It is noted that there is no disclosure of a method or apparatus as to how the resilient member is to be inserted within the carton, and the consequent aforementioned problems related thereto.

The present invention, unlike all the previously mentioned prior art references, provides a relatively simple and inexpensive way to centrally load flexible articles into a carton and, in the same operation, provide a supporting insert for these articles. The apparatus can also easily be adapted to centrally load non-symmetrical, gusseted, articles into the carton. None of the prior art references, taken singly or in combination, teach or even suggest the present invention as described herein.

SUMMARY OF THE INVENTION

Accordingly, it is a primary objective of the present invention to provide a novel method and apparatus for loading an empty carton or container with a complement of articles and to simultaneously provide the same with a supporting insert therein.

Another object of the present invention is to provide an apparatus and method for centrally loading a carton with a complement of articles thereby creating an evenly weighted carton and inherently providing greater ease in the later dispensing of the articles therein.

Still another object is to provide an apparatus and method for the central loading of non-symmetrical, i.e. gusseted, articles into the carton while simultaneously providing a supporting insert therein.

The present invention provides a novel apparatus and method for the central loading of symmetrical or non-symmetrical articles, typically plastic bags, into a container by providing a plunger which downwardly extends to force the articles into a carton. The plunger, however, has the additional capability of creating an internal vacuum which fastens a supporting insert to the plunger. The insert is then used to contact the stack of articles and push the same into the carton. The vacuum within the plunger is subsequently collapsed while the plunger is within the carton thereby releasing the insert while the insert is within the carton and additionally provides ease in the withdrawal of the plunger therefrom.

BRIEF DESCRIPTION OF THE DRAWINGS

The foregoing and other objects, advantages and characterizing features of the inventive loading method and apparatus of the present invention will become clearly apparent from the ensuing detailed description of an illustrative embodiment thereof, taken together with the accompanying drawings wherein like reference numerals denote like parts throughout the various views and in which.

DESCRITPION OF THE PREFERRED EMBODIMENTS

It should be realized that the present invention is directed to a relatively small feature within an overall forming and packaging apparatus and, consequently, drive and support assemblies, timing and safety circuits and the like, known and used by those skilled in the art, have been omitted in the interest in clarity.

Figure 1:
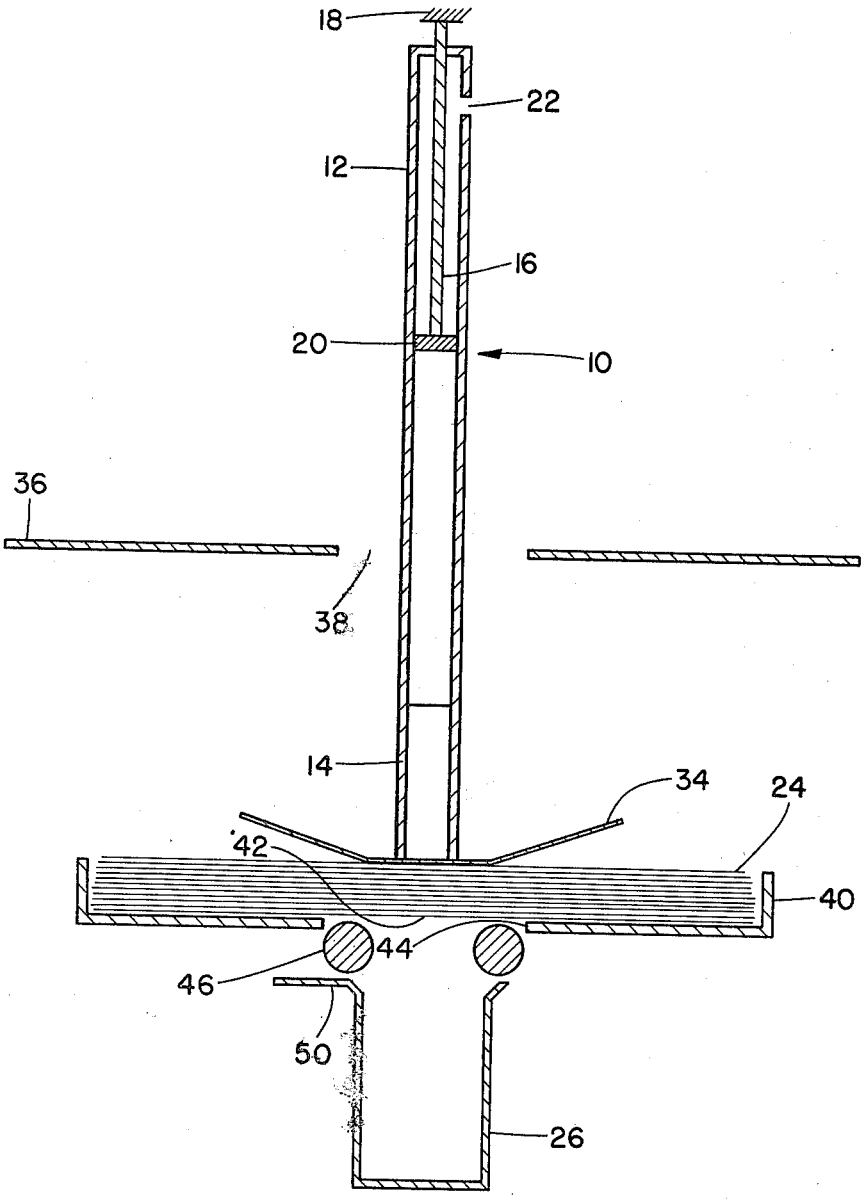
FIG. 1 is a side sectional view of a portion of the apparatus.

Referring now in detail to the drawings, the present invention contemplates the use of a hollow plunger 10 which has a body portion 12 and a foot portion 14. The body portion 12 is preferably comprised of at least one, and preferably two hollow cylindrical vacuum tubes which are detachably connected to the foot portion 14. The tubes 12 are preferably cylindrically shaped although different configurations, i.e. parallelograms, are contemplated to be within the scope of the present invention. As shown in FIG. 1, the tubes are provided with stationary piston rods 16 which are normally fixed to a point 18 on the framework of the overall apparatus (not shown). The stationary piston rods 16 may themselves fit snugly within the vacuum tubes 12 to prevent any air from traveling therearound, or may be provided with a piston head 20 which may also effectively restrict any air flow within the vacuum tubes. In a preferred embodiment, the tubes 12 are also provided with a hole 22 drilled completely through a side of the tube. The longitudinal placement of the hole 22 on the tube 12 is determined by measuring the distance the plunger 10 must downwardly travel in order to effectively force a full complement of articles 24 into a container 26 which is disposed below. The hole is placed at a distance above the bottom of the plunger 10 slightly less than the downward distance the plunger 10 must travel, so that the hole 22 will be positioned just below the end of the piston rod 16 or head 20 when the plunger 10 is in its downward-most position. The tubes or body portion 12 is further provided, as mentioned above, with an attached foot portion 14 which has on its lower end a substantially flat surface 28 which has at least one, and preferably two holes 30, which allow air to flow into the foot portion 14 and body portion 12 of the plunger 10.

Figure 2:
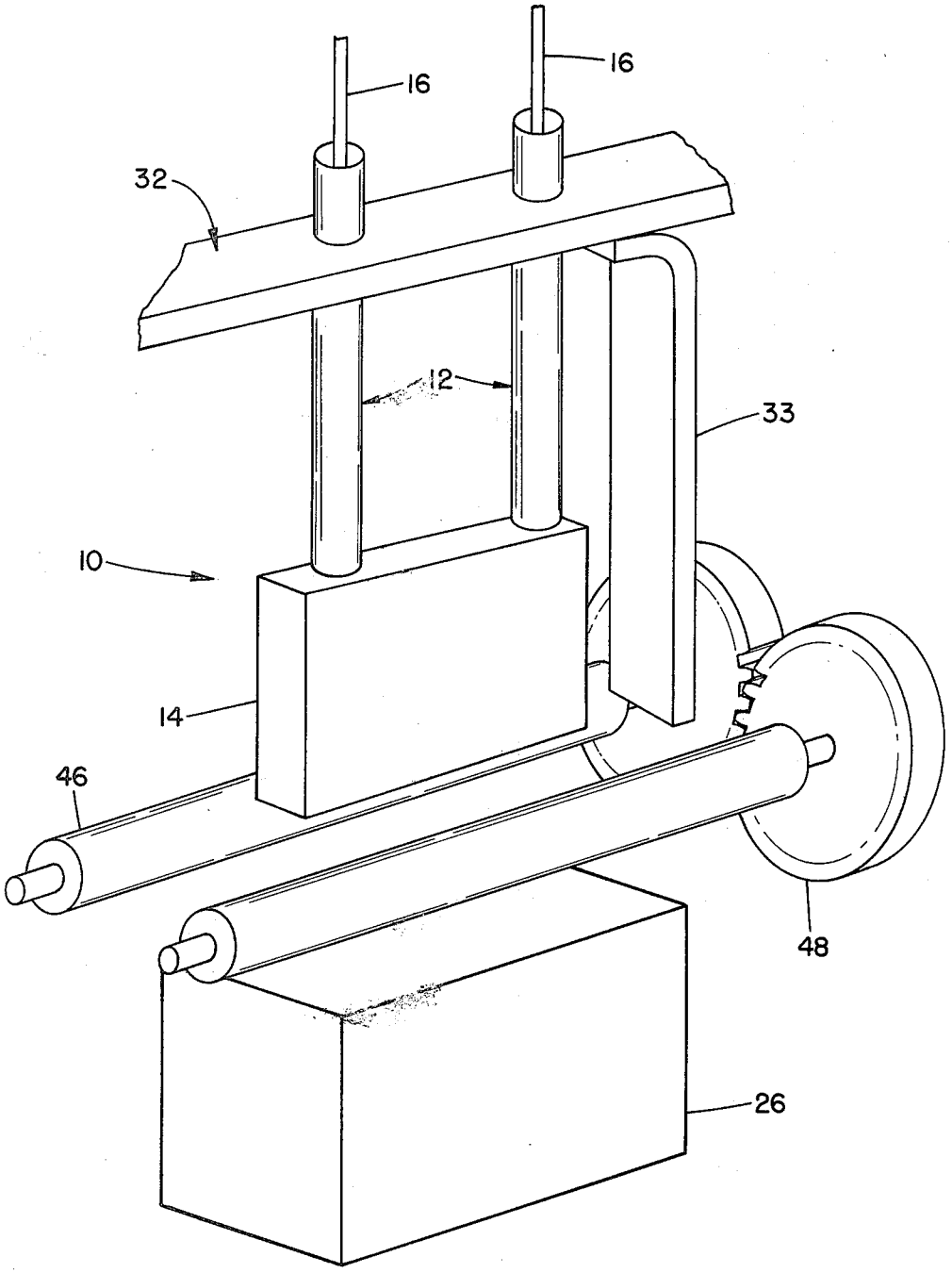
FIG. 2 is a perspective view of the movable components of the apparatus.
Figure 3:
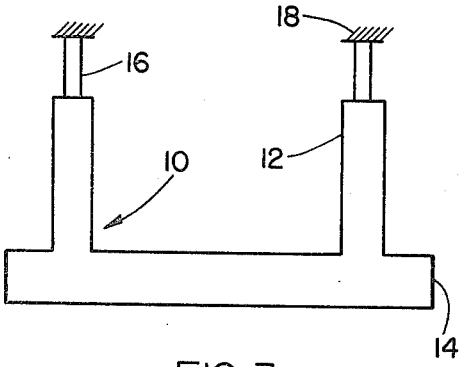
FIG. 3 is a side view of the foot and the plunger.
Figure 5:
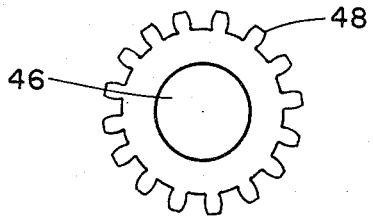
FIG. 5 is a side view of the geared end plate of the rollers.
Figure 4:
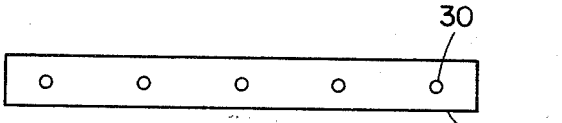
FIG. 4 is a bottom view of the foot.
Figure 6:
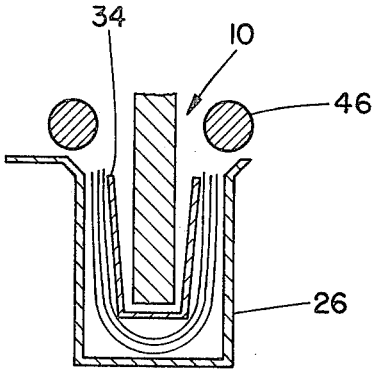
FIG. 6 is a side sectional view of the cardboard insert being placed within the carton with a full complement of articles.

The plunger 10 is moved upwardly and downwardly through the use of a carriage 32 which grips the vacuum tubes 12 so that the tubes 12 can, in turn, urge the foot 14 in the appropriate direction. Securely attached to the carriage 32 is a roller foot 33 which downwardly projects from the carriage and extends below the plunger as shown in FIG. 2. The roller foot 33 also extends out beyond the end of the carton 26 so that the roller foot 33 can cause the rotation of the rollers 46 throughout the entire downward motion of the plunger 10.

The carriage is further provided with means (not shown) for vertically moving the plunger assembly. Before the plunger is moved downward, an insert 34, which can be made from a resilient material or cardboard, is placed on a platform 36 which is disposed below the plunger 10 when the plunger is in its upward most position and has an opening which is large enough to easily allow the plunger 10 and cardboard insert 34 to pass therethrough.

Below the insert platform 36, an article retaining tray 40 is positioned, upon which a complement of articles 24, typically plastic bags, are stacked. The article retaining tray 40 is further provided with an opening 42 which is large enough to allow the articles 24 and the plunger 10 with insert 34 to fit therethrough. The opening 42 longitudinally extends at least the width of the articles 24 to be loaded into the carton or container 26, while it transversely extends at least the width of the plunger 10 and twice the thickness of the stack of articles 24, thereby allowing the articles and plunger to pass therethrough. Directly therebelow, and along the sides 44 of the opening 42, guiding rollers 46 are provided to guide the articles from the tray 40 into the carton 26. The rollers are covered with rubber or other resilient material which provides a surface which tends to grip the articles disposed within the article retaining tray 40. The rollers are further provided with geared end plates 48 which have gear teeth which intermeshingly engage so as to synchronize the motion of the rollers 46. This gearing enables the rollers to rotate at the same relative speed thereby allowing an effective gripping or urging of the stack 24. In conjunction with this synchronized rotational movement, the present invention contemplates synchronizing the movement of the rollers 46 with the downward motion of the plunger 10. This is accomplished by roller foot 33 coming into contact with rollers 46 at the moment the insert 34, forced downward by plunger 10, comes in contact with the stack of articles 24. The roller foot 33 has a width slightly greater than the distance between the rollers 46 and as such, simultaneously urges the rollers 46 into motion when the stack of articles 24 is downwardly urged.

Below the rollers 46, an empty container, normally a carton 26, is diposed to receptably receive the articles 24 and insert 34. The carton is normally loaded through its bottom 50 and is subsequently sealed (not shown) after it has been filled with articles 24.

Figure 7:
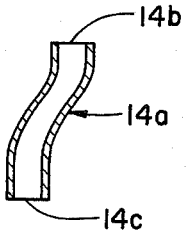
FIG. 7 is a side sectional view of the foot to be used for non-symmetrical, gusseted articles in the present invention.

FIG. 7 discloses, in another embodiment, the foot **14*a* which is attached to the plunger 10 and is offset to provide for the loading of non-symmetrical, gusseted articles. Particularly, the plunger body 12 is connected to the foot at 14*b* thereby offsetting the longitudinal axis of the plunger 10 in relation to the transverse axis of the stack of articles. The lower flat surface 14*c* of the foot, however, remains aligned along the transverse axis of the stack and upon the lowering, the foot 14*a* as outlined above will centrally force the stack 24 into the carton 26. The amount of offset is determined in practice by the difference in width between the gusseted end of the stack of plastic bags and the non-gusseted end of the stack. Upon insertion of the plunger into the carton, the offset allows the gusseted bags to be centrally forced into the carton 26** by compensating for the required increase in space required within the carton for the gusseted ends.

In operation, the plunger 10 with body portion 12 and foot portion 14 are disposed above the insert platform 36. A cardboard insert 34 is placed on the platform and the plunger is lowered into contact with the cardboard insert 34. As the plunger continues to be lowered, a stationary piston 16 prevents any air from entering the enlarging area between piston head 20 and the flat surface 28 of the foot portion. This motion of the plunger creates a vacuum within the plunger because the piston head 20 and the cardboard insert 24 both prevent air from entering the plunger 10, while the volume therein increases with the downward motion. The vacuum within the plunger 10 affixes the insert 34 to the plunger 10. The plunger centrally contacts the stack and forces the stack through the opening 42 of the article retaining tray 40. Simultaneously, the roller foot 33 is forced between the rollers 46 thereby forcing or urging the rollers into rotational movement, such rotation causing the articles 24 to more easily enter the container 26 disposed directly below. The rollers are further provided with geared end plates 48 so as to synchronize the respective motion of the rollers 46 to prevent the articles from being pulled from either side at a different speed. This synchronization further assures the central loading of the stack. Upon continued lowering, the plunger 10 with insert 34 and articles 24 are forced into the carton 26. The opening 22 passes below the piston 16 or head 20 thereby collapsing the vacuum within the body portion 12. The plunger 10 is then removed from the container 26 and the insert 34 is consequently retained therein.

It should be realized that in the alternative embodiment the foot **14*a* is attached to the plunger body 12**. The operation of this embodiment is the same as that described above with the only difference being that the plunger is offset from the vertical axis of the center of the article stack a distance equal to half the total thickness of the gusseted ends of the plastic bags minus the total thickness of the non-gusseted ends.

From the foregoing, it is apparent that the objects of the present invention have been fully accomplished. As a result of the present invention, a novel method and apparatus for carton loading have been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. An apparatus for the loading of flexible articles into a container comprising:

a. a plunger comprised of a body portion and a foot portion;

b. vacuum means for temporarily affixing an insert to said foot portion;

c. a tray for retaining a stack of articles in spaced relation below both said plunger and said insert; said tray having an opening therein;

d. an empty container receptably disposed below said opening in said article retaining tray;

e. means for moving said plunger to carry said insert from its spaced position above said stack into engagement with said stack and for forcing the articles and said insert into said container with said foot portion; and f. means for releasing said insert from said foot portion at a location within said container.

2. An apparatus as defined in claim 1, said plunger having a substantially hollow configuration and a longitudinal axis.

3. An apparatus as defined in claim 2, said body portion comprising an end having a generally flat surface having at least one opening therein.

4. An apparatus as defined in claim 3, said body portion having a cylindrical shape.

5. An apparatus as defined in claim 4, said means for affixing said insert to said plunger comprising a piston permanently affixed to a stationary base, said piston having a configuration which snugly fits within a cylinder thereby preventing any air from traveling past said piston.

6. An apparatus as defined in claim 5, said carton having its bottom end open to receptably receive said articles.

7. An apparatus as defined in claim 5, said piston configuration comprising a piston having a head portion extending snugly into said plunger.

8. An apparatus as defined in claim 7, said means for retaining said insert within said carton comprising an opening in said body portion of the plunger wherein which, upon the lowering of the plunger the distance required to force the articles completely into said carton, the opening is positioned below said piston head allowing air to enter the plunger body thereby collapsing a vacuum therein and releasing said insert from said foot portion.

9. An apparatus as defined in claim 2, said foot portion of the plunger extending below and coaxially with the longitudinal axis of said body.

10. An apparatus as defined in claim 2, said foot portion of the plunger extending from said body and having a flat surface end thereof offset from the longitudinal axis of said body.

11. An apparatus as defined in claim 1, said apparatus further comprising a means for guiding said stack of articles into said container.

12. An apparatus as defined in claim 11, said means for guiding said articles into said carton comprising a pair of rollers disposed below and along longitudinal sides of said opening and further disposed above the sides of said carton whereby said articles are rolled by said rollers to guide the articles into the carton disposed directly therebelow.

13. An apparatus as defined in claim 12, said pair of rollers having end plates, said plates having gear teeth which intermeshingly interact to synchronize the relative movement of the rollers.

14. An apparatus as defined in claim 13, said roller movement synchronized with the downward movement of said plunger.

15. An apparatus as defined in claim 14, said synchronization comprising a roller foot which urges the rollers into rotational movement.

16. An apparatus as defined in claim 15, said offset of the flat surface comprising a distance equal to half the total thickness of the gusseted ends of said plastic bags minus the total thickness of the non-gusseted ends.

17. An apparatus as defined in claim 1, said insert comprised of cardboard.

18. An apparatus as defined in claim 1, said container comprising a carton.

19. An apparatus as defined in claim 1, said means for forcing said articles into said carton comprising said plunger whereby said plunger is brought into contact with the center of said stack; an opening in said tray for retaining said articles, said carton being disposed directly below said plunger and said stack.

20. An apparatus as defined in claim 1, said bags comprising a plastic gusseted configuration.

21. An apparatus as defined in claim 1, said articles comprised of plastic bags.

22. A method for the loading of a stack of bags or the like into a carton comprising:

a. lowering a plunger having a foot thereon;
b. contacting with an end surface of said foot a cardboard insert;
c. temporarily vacuum affixing said cardboard insert to said foot and holding said insert against said foot while in spaced relationship above said stack of bags;
d. lowering said plunger and cardboard insert configuration to contact the central area of said stack of bags being held in a retaining tray;
e. continued lowering of said plunger and cardboard insert to force the bags through an opening in said retaining tray and into a carton disposed below said opening;
f. guiding said bags from said opening into said carton; and
g. releasing said cardboard insert in said carton to support said bags disposed therein.

23. A method as defined in claim 22, affixing said cardboard insert to said foot comprising creating a vacuum within said plunger by lowering said plunger about a stationary piston disposed therein so as to increase a volume within the plunger between said end surface and said piston without allowing any air to enter said volume.

24. A method as defined in claim 23, releasing said cardboard insert comprised of collapsing said vacuum within the plunger by allowing air to enter therein.

25. A method as defined in claim 22, said method for guiding comprised of rollingly engaging the stack of articles with rollers disposed therebelow.

26. A method as defined in claim 25, said rolling engagement further comprising synchronizing said rollers so as to provide constant velocity therebetween.

27. A method as defined in claim 26, said synchronization comprising rotating said rollers by lowering a roller foot therebetween.

* * * * *